US011019901B2

(12) United States Patent
Wang

(10) Patent No.: US 11,019,901 B2
(45) Date of Patent: Jun. 1, 2021

(54) EYELASH CURLER

(71) Applicant: Good Chance Industries Co., Ltd., Changhua (TW)

(72) Inventor: Jen-Rong Wang, Changhua (TW)

(73) Assignee: Good Chance Industries Co., Ltd., Changhua (TW)

( * ) Notice: Subject to any disclaimer, the term of this patent is extended or adjusted under 35 U.S.C. 154(b) by 355 days.

(21) Appl. No.: 15/873,960

(22) Filed: Jan. 18, 2018

(65) Prior Publication Data

US 2019/0216198 A1 Jul. 18, 2019

(51) Int. Cl.
*A45D 2/48* (2006.01)

(52) U.S. Cl.
CPC ..... *A45D 2/48* (2013.01)

(58) Field of Classification Search
CPC ..... A45D 2/30; A45D 2/48; A45D 2200/18; A45D 2200/1036; A45D 40/02; A45D 1/00; A45D 2/00; A45D 40/30; A45D 44/00; A41G 5/02
USPC ..... 132/212, 216, 218, 320, 304, 288
See application file for complete search history.

(56) References Cited

U.S. PATENT DOCUMENTS 3,016,059 A * 1/1962 Hutton ..... A45D 2/48 132/217
4,305,412 A * 12/1981 Nist ..... A45D 2/48 132/217
5,524,649 A * 6/1996 Suh ..... A45D 2/48 132/216
5,598,858 A * 2/1997 Wainer ..... A45D 2/48 132/216
6,105,585 A * 8/2000 Thomas ..... A45D 34/042 132/216
6,789,551 B2 * 9/2004 Iosilevich ..... A45D 2/48 132/216
2007/0163613 A1 * 7/2007 Lee ..... A45D 34/04 132/216
2013/0074865 A1 * 3/2013 Santillan ..... A45D 2/48 132/217
2015/0122285 A1 * 5/2015 Horino ..... A45D 2/48 132/217

(Continued)

FOREIGN PATENT DOCUMENTS

JP 3195063 U * 10/2014 ..... A45D 2/48
TW M491375 U * 7/2014 ..... A45D 2/48

*Primary Examiner* — Rachel R Steitz
*Assistant Examiner* — Karim Asqiriba
(74) *Attorney, Agent, or Firm* — Alan D. Kamrath; Karin L. Williams; Mayer & Williams PC

(57) ABSTRACT

An eyelash curler includes a primary handle, a secondary handle pivotally connected with the primary handle, an upper curved plate secured on the secondary handle, a lower curved plate movably mounted on the secondary handle, and a clamping member mounted on the lower curved plate and facing the upper curved plate. The clamping member has a bottom provided with a mounting portion received in the recessed seat and has a top provided with a clamping portion which has a higher front arcuate guide face and a lower rear arcuate guide face. The front arcuate guide face and the rear arcuate guide face have a connection having a central line aligning with a lower pressing edge of the upper curved plate. The clamping portion has two ends each provided with an extension.

14 Claims, 9 Drawing Sheets

(56) References Cited

U.S. PATENT DOCUMENTS

| | | | | |
|---|---|---|---|---|
| 2017/0231351 | A1* | 8/2017 | Cho | A45D 2/48<br>132/217 |
| 2019/0216198 | A1* | 7/2019 | Wang | A45D 2/48 |

* cited by examiner

EYELASH CURLER

BACKGROUND OF THE INVENTION

1. Field of the Invention

The present invention relates to a personal adornment and, more particularly, to an eyelash curler.

2. Description of the Related Art

A conventional eyelash curler 10 in accordance with the prior art shown in FIGS. 10 and 11 comprises a primary handle 11, a secondary handle 12, an upper curved plate 13, a lower curved plate 14, and a clamping member 15. The primary handle 11 is pivotally connected with the secondary handle 12. The upper curved plate 13 is secured on the secondary handle 12. The lower curved plate 14 is movably mounted on the secondary handle 12 and movable relative to the upper curved plate 13. Thus, the upper curved plate 13 and the lower curved plate 14 form a closed state or an opened state by a pivoting action between the primary handle 11 and the secondary handle 12. The lower curved plate 14 is provided with a recessed seat 141. The clamping member 15 has a top provided with an arcuate pressing face 151 and has a bottom provided with a mounting portion 152 received in the recessed seat 141 of the lower curved plate 14. In operation, an eyelash "A" is initially placed on the clamping member 15. Then, the lower curved plate 14 is pushed upward toward the upper curved plate 13 by the pivoting action between the primary handle 11 and the secondary handle 12, so that the clamping member 15 is moved to press the upper curved plate 13, and the eyelash "A" is clamped between the pressing face 151 of the clamping member 15 and the upper curved plate 13. In such a manner, the rear end portion "A1" of the eyelash "A" is compressed between the pressing face 151 of the clamping member 15 and the upper curved plate 13, while the front end portion "A2" of the eyelash "A" is curled upward. However, the pressing face 151 of the clamping member 15 has a smooth arcuate shape so that the pressing face 151 of the clamping member 15 cannot press the eyelash "A" exactly. Thus, the eyelash "A" is easily detached from the pressing face 151 of the clamping member 15 and cannot press the eyelash "A" so that the user has to repeatedly clamp the eyelash "A" many times so as to curl the eyelash "A", thereby wasting the energy and time. In addition, the pressing face 151 and the mounting portion 152 of the clamping member 15 have the same length, so that the distal ends of the eyelash "A" cannot be extended outward during the clamping process of the eyelash "A" as shown in FIG. 10, thereby decreasing the curling effect of the eyelash "A".

BRIEF SUMMARY OF THE INVENTION

The primary objective of the present invention is to provide an eyelash curler that positions and clamps the user's eyelash easily, quickly and conveniently.

In accordance with the present invention, there is provided an eyelash curler comprising a primary handle, a secondary handle, an upper curved plate, a lower curved plate and a clamping member. The primary handle is pivotally connected with the secondary handle. The upper curved plate is secured on the secondary handle. The lower curved plate is movably mounted on the secondary handle. The lower curved plate is provided with a recessed seat. The clamping member is mounted on the lower curved plate and faces the upper curved plate. The clamping member is an arcuate elastic strip which is formed integrally by injection molding. The clamping member includes an elongate arcuate section and a short arcuate section located under the elongate arcuate section. The clamping member has a bottom provided with a mounting portion received in the recessed seat of the lower curved plate. The clamping member has a top provided with a clamping portion corresponding to the upper curved plate. The clamping portion of the clamping member has a first side provided with a front arcuate guide face and a second side provided with a rear arcuate guide face lower than the front arcuate guide face. The front arcuate guide face and the rear arcuate guide face of the clamping member have a connection having a central line aligning with a lower pressing edge of the upper curved plate. The clamping portion of the clamping member has two ends each provided with an extension extending outward. An eyelash is clamped between the clamping portion of the clamping member and the upper curved plate, with a front end portion of the eyelash contacting the front arcuate guide face of the clamping member, and with a rear end portion of the eyelash contacting the rear arcuate guide face of the clamping member. The front arcuate guide face of the clamping member constructs a primary force bearing face, and the rear arcuate guide face of the clamping member constructs a secondary force bearing face. When the eyelash is clamped between the clamping portion of the clamping member and the upper curved plate, the eyelash is bent to rest on a face of the upper curved plate, and the front end portion of the eyelash is curled upward.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
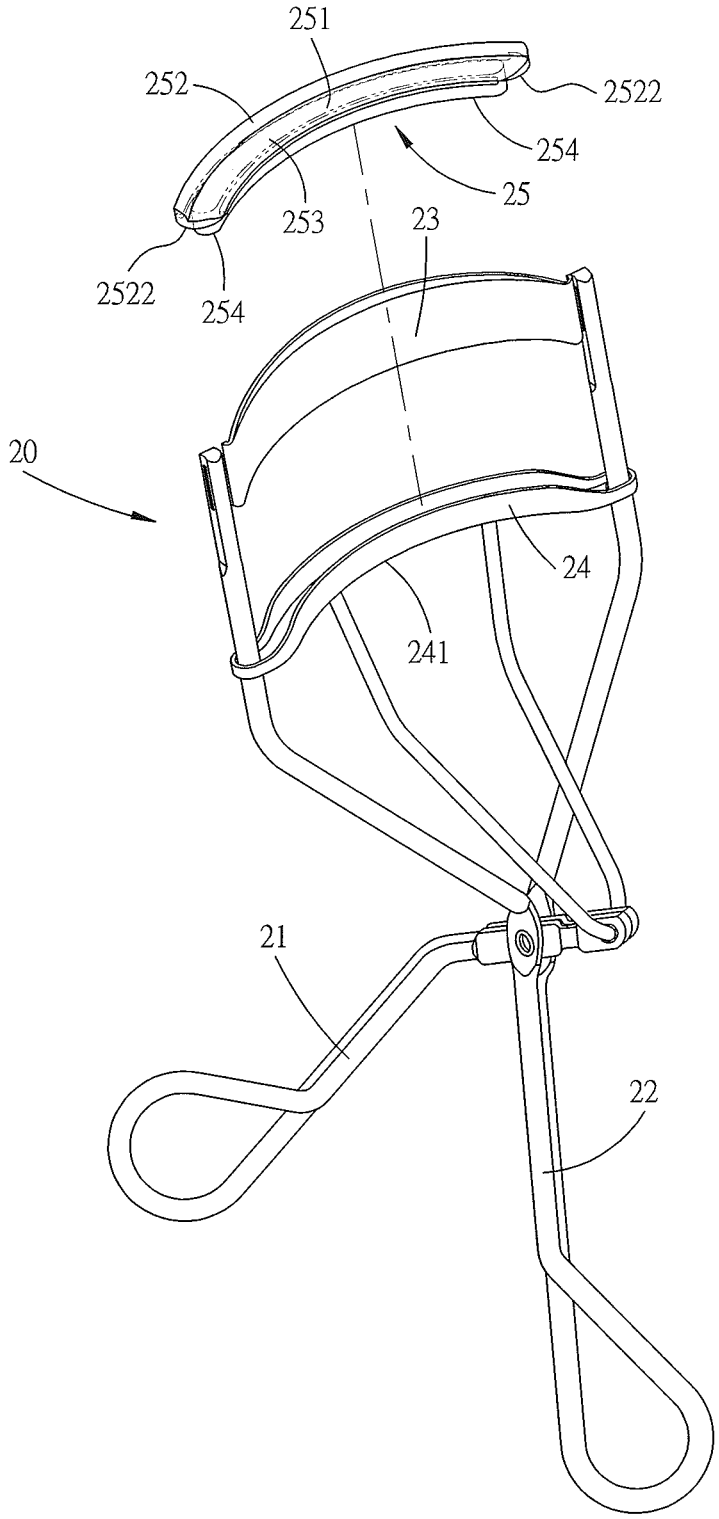
FIG. 1 is a partially exploded perspective view of an eyelash curler in accordance with the preferred embodiment of the present invention.
Figure 2:
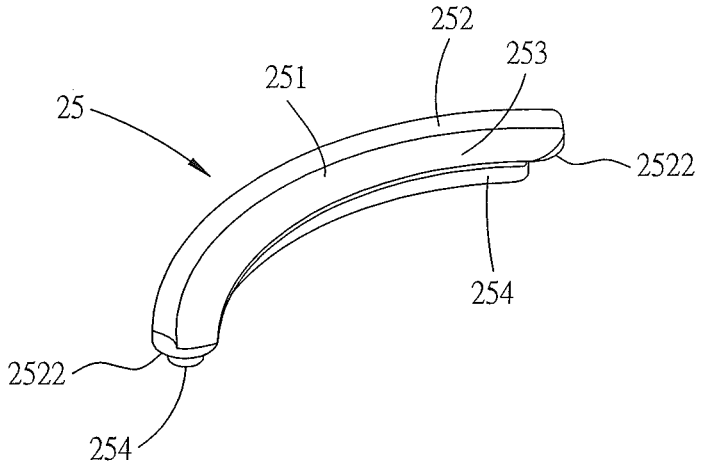
FIG. 2 is a perspective view of a clamping member of the eyelash curler in accordance with the preferred embodiment of the present invention.
Figure 3:
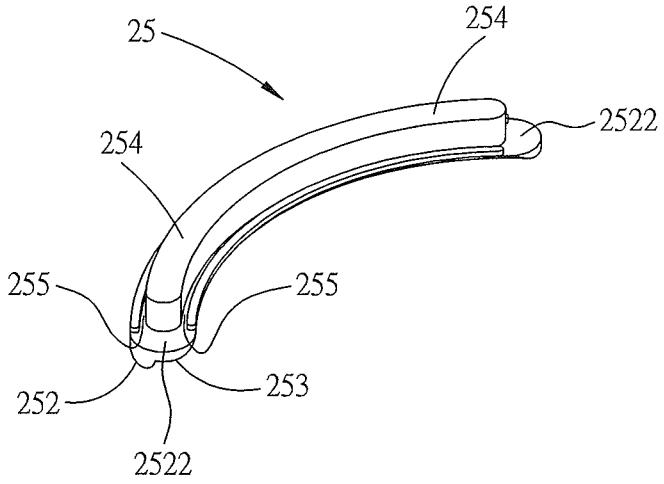
FIG. 3 is a bottom perspective view of the clamping member of the eyelash curler in accordance with the preferred embodiment of the present invention.
Figure 4:
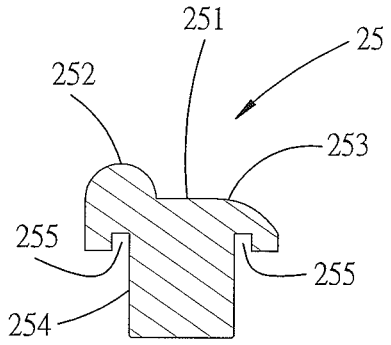
FIG. 4 is a side cross-sectional view of the clamping member of the eyelash curler in accordance with the preferred embodiment of the present invention.
Figure 5:
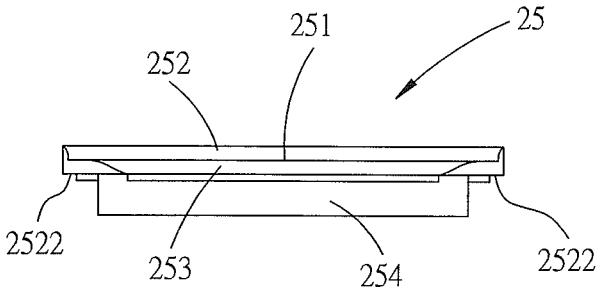
FIG. 5 is a front view of the clamping member of the eyelash curler in accordance with the preferred embodiment of the present invention.
Figure 6:
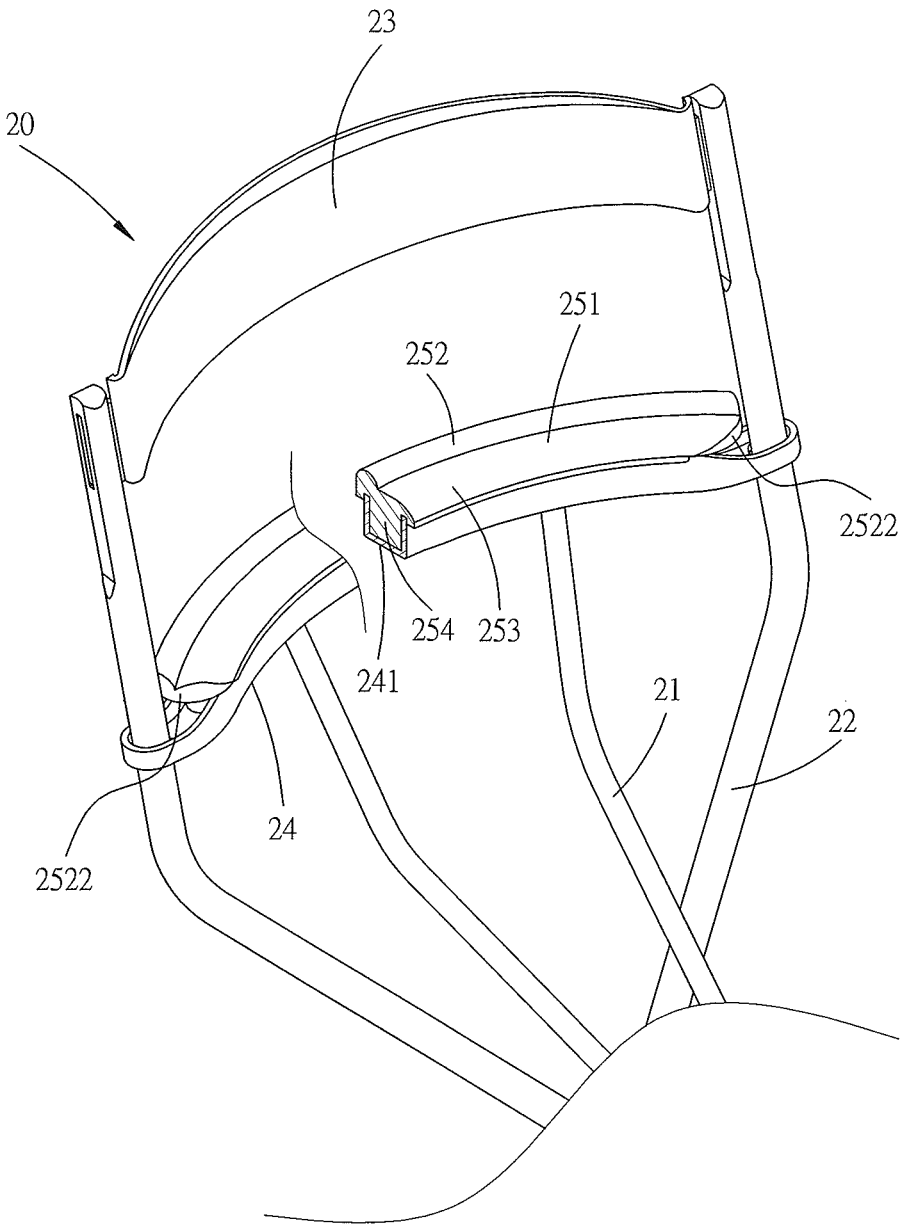
FIG. 6 is a partially perspective cross-sectional assembly view of the eyelash curler in accordance with the preferred embodiment of the present invention.

Referring to the drawings and initially to FIGS. 1-6, an eyelash curler 20 in accordance with the preferred embodiment of the present invention comprises a primary handle 21, a secondary handle 22, an upper curved plate 23, a lower curved plate 24 and a clamping member 25.

The primary handle 21 is pivotally connected with the secondary handle 22. The upper curved plate 23 is secured on the secondary handle 22. The lower curved plate 24 is movably mounted on the secondary handle 22 and is movable relative to the upper curved plate 23. Thus, the upper curved plate 23 and the lower curved plate 24 form a closed state or an opened state by a pivoting action between the primary handle 21 and the secondary handle 22. The lower curved plate 24 is provided with a recessed seat 241.

The clamping member 25 is located between the upper curved plate 23 and the lower curved plate 24. The clamping member 25 is mounted on the lower curved plate 24 and faces the upper curved plate 23. The clamping member 25 is an arcuate elastic strip which is formed integrally by injection molding. Preferably, the clamping member 25 is made of rubber or plastic material. The clamping member 25 includes an elongate arcuate section and a short arcuate section located under the elongate arcuate section.

The clamping member 25 has a bottom provided with a mounting portion 254 received in the recessed seat 241 of the lower curved plate 24. The mounting portion 254 of the clamping member 25 has two opposite sides each provided with a locking groove 255 locked onto a peripheral wall of the recessed seat 241 of the lower curved plate 24, so that the clamping member 25 is positioned on the recessed seat 241 of the lower curved plate 24. The locking groove 255 of the clamping member 25 has a shape similar to that of the mounting portion 254, for example, an inverted U-shaped profile.

The clamping member 25 has a top provided with a clamping portion 251 corresponding to the upper curved plate 23. The clamping portion 251 of the clamping member 25 has a stepped shape and has a first side provided with a front arcuate guide face 252 and a second side provided with a rear arcuate guide face 253 lower than the front arcuate guide face 252. The front arcuate guide face 252 and the rear arcuate guide face 253 of the clamping member 25 have a connection having a central line aligning with a lower pressing edge of the upper curved plate 23. The clamping portion 251 of the clamping member 25 has two ends each provided with an extension 2522 extending outward. The extension 2522 of the clamping member 25 has a distal portion protruding outward from the mounting portion 254. Thus, the clamping portion 251 of the clamping member 25 has a length greater than that of the mounting portion 254, so that the clamping portion 251 and the mounting portion 254 of the clamping member 25 form a stepped gap.

Figure 7:
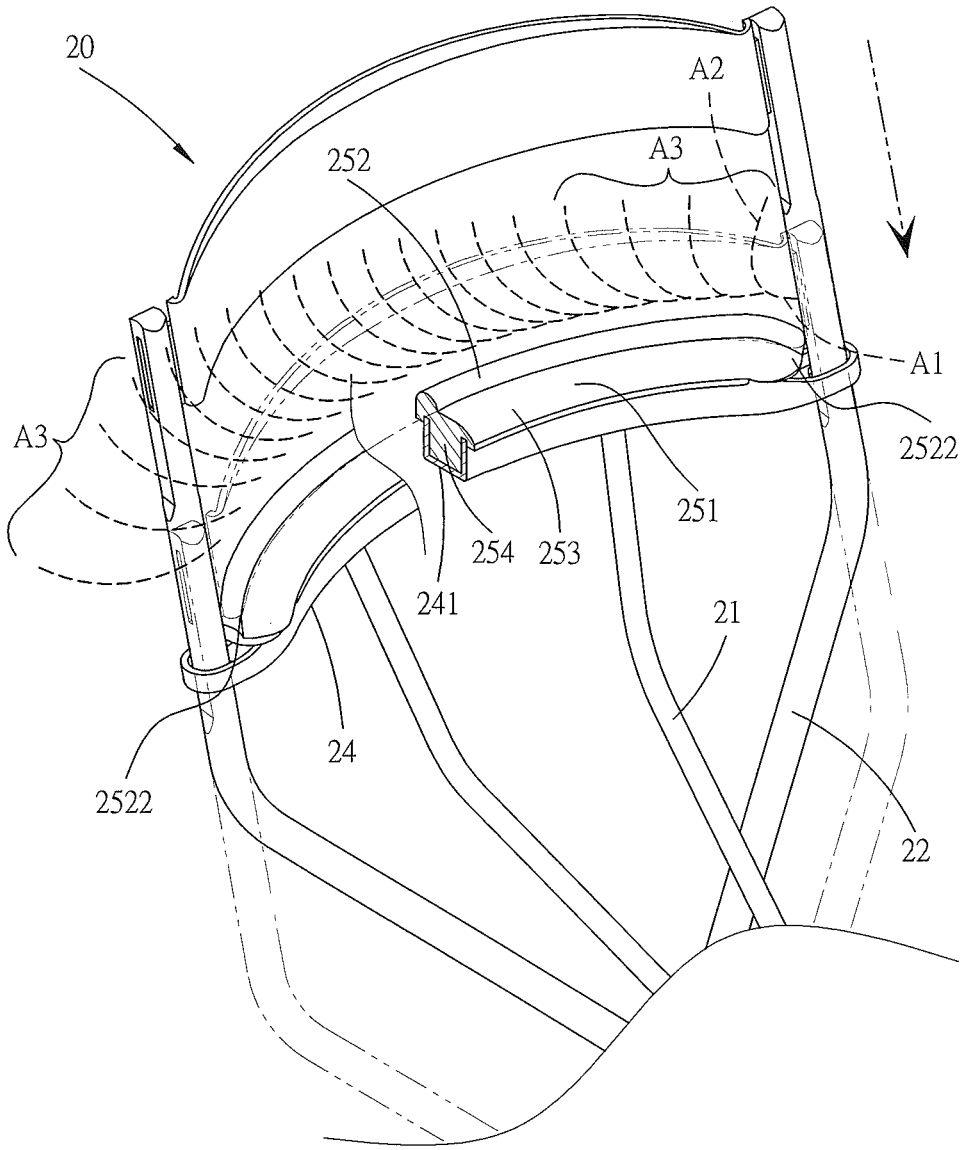
FIG. 7 is a schematic operational view of the eyelash curler as shown in FIG. 6 in use.
Figure 8:
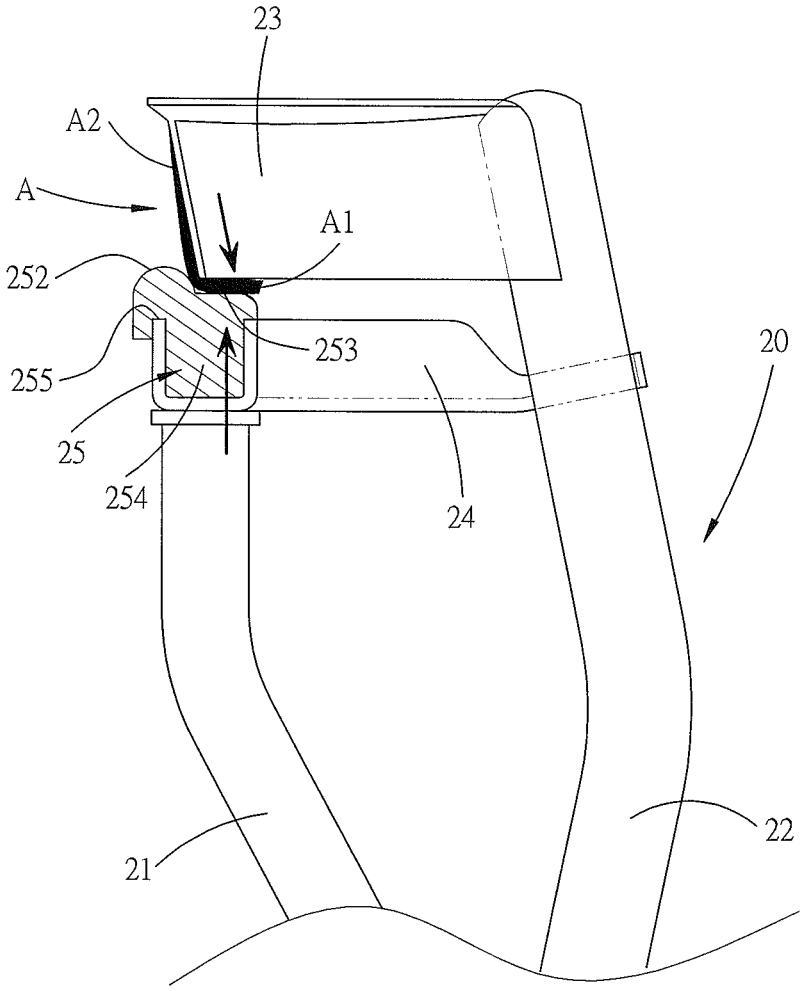
FIG. 8 is a side cross-sectional operational view of the eyelash curler as shown in FIG. 7.

In operation, referring to FIGS. 7 and 8 with reference to FIGS. 1-6, an eyelash "A" is initially placed on the clamping member 25. Then, the lower curved plate 24 is pushed upward toward the upper curved plate 23 by the pivoting action between the primary handle 21 and the secondary handle 22, so that the clamping member 25 is driven by the lower curved plate 24 and is moved toward the upper curved plate 23 to press the upper curved plate 23, and the eyelash "A" is clamped between the clamping portion 251 of the clamping member 25 and the upper curved plate 23. In such a manner, a front end portion "A2" of the eyelash "A" contacts the front arcuate guide face 252 of the clamping member 25, and a rear end portion "A1" of the eyelash "A" contacts the rear arcuate guide face 253 of the clamping member 25. At this time, the front arcuate guide face 252 of the clamping member 25 is located at a higher position, and the rear arcuate guide face 253 of the clamping member 25 is located at a lower position, so that when the eyelash "A" is clamped between the clamping member 25 and the upper curved plate 23, the front arcuate guide face 252 of the clamping member 25 constructs a primary force bearing face, and the rear arcuate guide face 253 of the clamping member 25 constructs a secondary force bearing face. In such a manner, the clamping member 25 is an arcuate elastic strip, and the lower pressing edge of the upper curved plate 23 aligns with the central line of the connection of the front arcuate guide face 252 and the rear arcuate guide face 253 of the clamping member 25, so that when the eyelash "A" is clamped between the clamping portion 251 of the clamping member 25 and the upper curved plate 23, the eyelash "A" is bent to rest on the face of the upper curved plate 23, and the front end portion "A2" of the eyelash "A" is curled upward as shown in FIG. 8. At the same time, when the clamping portion 251 of the clamping member 25 is compressed, the extension 2522 of the clamping member 25 is stretched and extended outward, so that the two distal ends "A3" (see FIG. 7) of the eyelash "A" are outward stretched and curled naturally, thereby preventing the root of the eyelash "A" from being plucked. Thus, the eyelash "A" is curled to have an arcuate warped shape.

Figure 9:
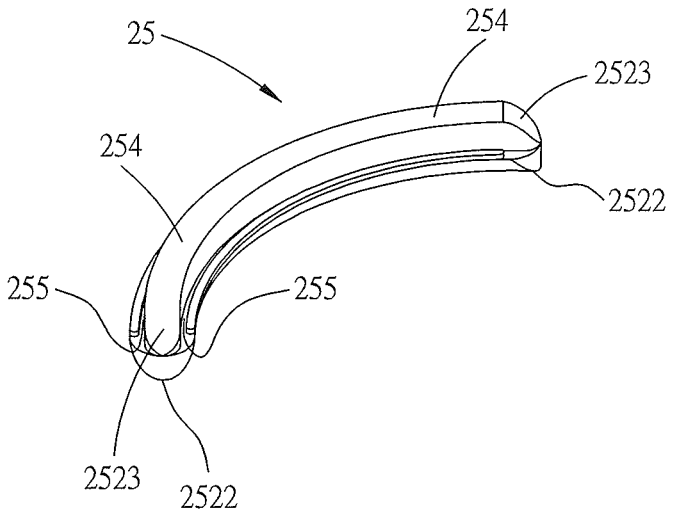
FIG. 9 is a bottom perspective view of a clamping member of the eyelash curler in accordance with another preferred embodiment of the present invention.
Figure 10:
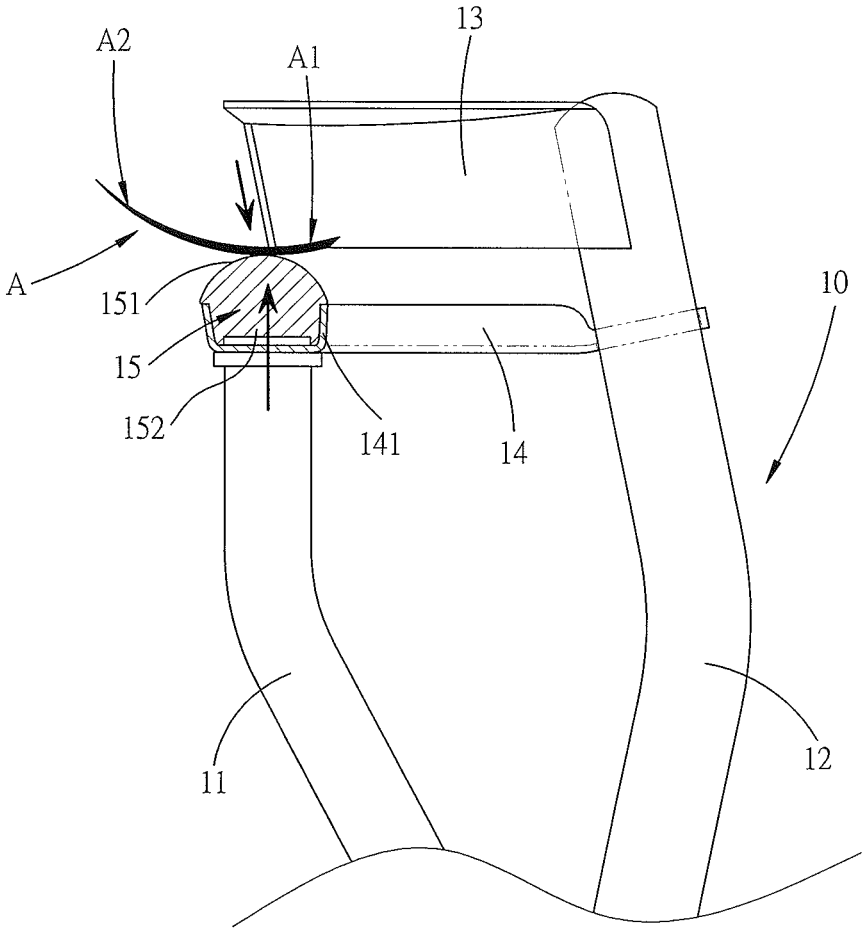
FIG. 10 PRIOR ART
FIG. 10 is a side cross-sectional operational view of a conventional eyelash curler in accordance with the prior art.
Figure 11:
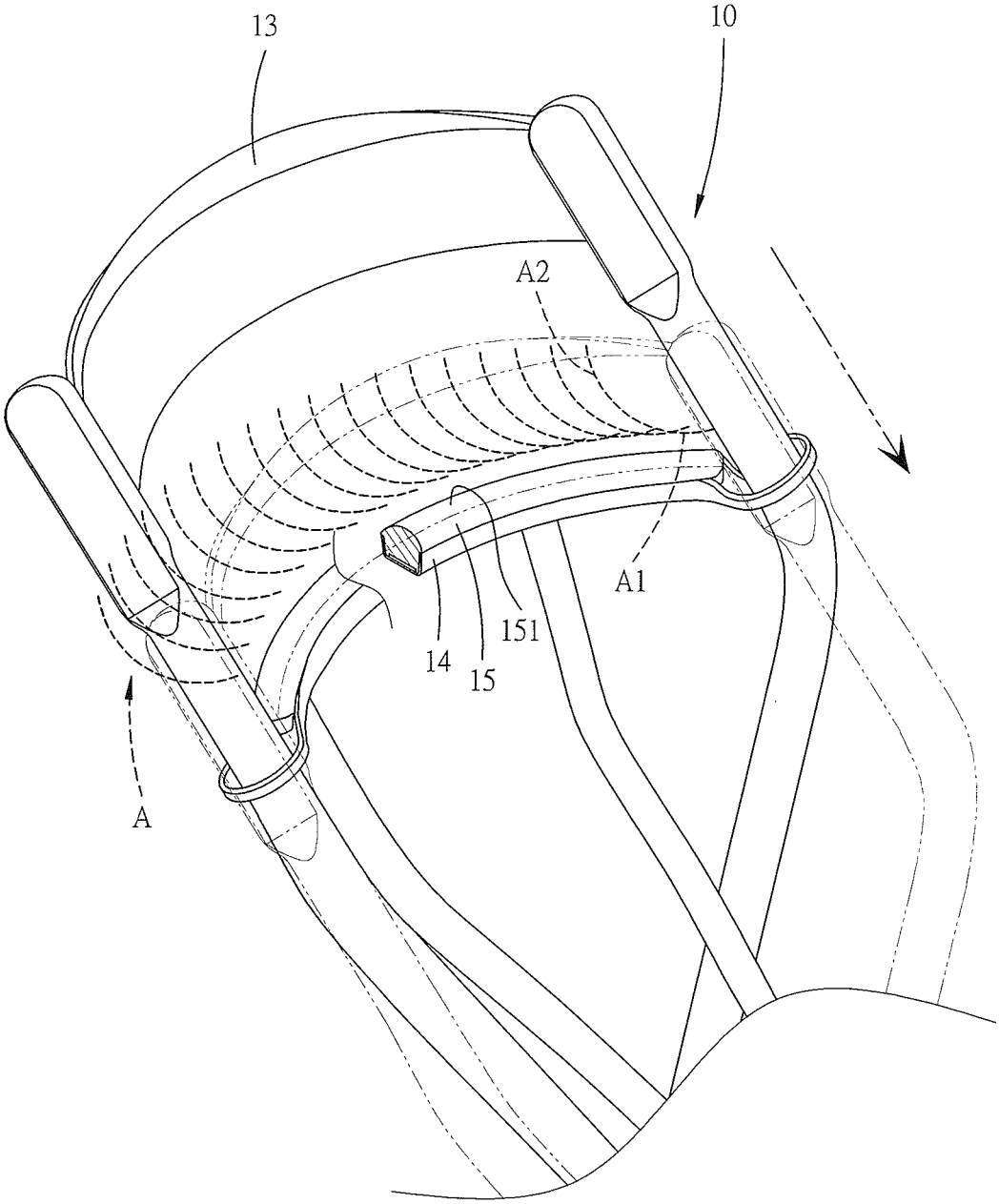
FIG. 11 PRIOR ART
FIG. 11 is a partially perspective cross-sectional operational view of the conventional eyelash curler in accordance with the prior art.

Referring now to FIG. 9, the extension 2522 of the clamping portion 251 of the clamping member 25 has a bottom provided with an oblique face 2523 connected to the mounting portion 254. Thus, when the clamping member 25 is compressed, the extension 2522 of the clamping portion 251 of the clamping member 25 is extended outward.

Accordingly, the eyelash "A" is exactly positioned between and will not be detached from the clamping portion 251 of the clamping member 25 and the upper curved plate 23 to facilitate the user curling the eyelash "A". In addition, the eyelash "A" is directly pressed between the clamping portion 251 of the clamping member 25 and the upper curved plate 23 so that the user can easily and quickly clamp and curl the eyelash "A" at a time, without having to successively apply forces many times for clamping the eyelash "A", thereby greatly saving the user's energy and time.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An eyelash curler comprising:

a primary handle, a secondary handle, an upper curved plate, a lower curved plate and a clamping member;

wherein:

the primary handle is pivotally connected with the secondary handle;

the upper curved plate is secured on the secondary handle;

the lower curved plate is movably mounted on the secondary handle;

the lower curved plate is provided with a recessed seat;

the clamping member is mounted on the lower curved plate and faces the upper curved plate;

the clamping member has a bottom provided with a mounting portion received in the recessed seat of the lower curved plate;

the mounting portion of the clamping member has two opposite sides each provided with a locking groove locked onto a peripheral wall of the recessed seat of the lower curved plate, so that the clamping member is securely positioned on the recessed seat of the lower curved plate;

the locking groove of the clamping member has an inverted U-shaped profile and encompasses the peripheral wall of the recessed seat of the lower curved plate, so that the locking groove of the clamping member is locked onto the recessed seat of the lower curved plate;

the clamping member has a top provided with a clamping portion corresponding to the upper curved plate;

the clamping portion of the clamping member has a first side provided with a front arcuate guide face and a second side provided with a rear arcuate guide face lower than the front arcuate guide face;

the clamping portion of the clamping member has a flat support face defined between the front arcuate guide face and the rear arcuate guide face;

the front arcuate guide face extends longitudinally along the clamping portion;

the rear arcuate guide face extends longitudinally along the clamping portion;

the front arcuate guide face and the rear arcuate guide face of the clamping member have a connection having a central line aligning with a lower pressing edge of the upper curved plate; and the clamping portion of the clamping member has two ends each provided with an extension extending outward.

2. The eyelash curler of claim 1, wherein the extension of the clamping portion of the clamping member has a bottom provided with an oblique face extending outward from and connected to the mounting portion.

3. The eyelash curler of claim 1, wherein the locking groove of the clamping member has a shape corresponding to that of the peripheral wall of the recessed seat.

4. The eyelash curler of claim 1, wherein:

the extension of the clamping member has a distal portion protruding outward from the mounting portion;

a stepped portion is defined between the distal portion of the extension of the clamping member and the mounting portion;

the clamping portion of the clamping member has a length more than that of the mounting portion; and when the clamping portion of the clamping member is compressed, the extension of the clamping member is stretched outward.

5. The eyelash curler of claim 1, wherein the clamping portion of the clamping member has a stepped shape with a height difference.

6. The eyelash curler of claim 1, wherein the extension directly extends and protrudes outward from each of two ends of the mounting portion.

7. The eyelash curler of claim 1, wherein the mounting portion of the clamping member extends downward from a bottom of the clamping portion.

8. The eyelash curler of claim 1, wherein the clamping portion of the clamping member has a width more than that of the mounting portion.

9. The eyelash curler of claim 1, wherein the clamping portion of the clamping member has a width more than that of the recessed seat of the lower curved plate.

10. The eyelash curler of claim 1, wherein the clamping portion of the clamping member has two opposite sides protruding outward from the mounting portion.

11. The eyelash curler of claim 10, wherein the mounting portion of the clamping member is located at a middle of the two opposite sides of the clamping portion.

12. The eyelash curler of claim 1, wherein the locking groove of the clamping member extends upward into the clamping portion and forms a recessed portion enclosed around the peripheral wall of the recessed seat of the lower curved plate.

13. The eyelash curler of claim 1, wherein the mounting portion is located between the locking grooves at the two opposite sides.

14. The eyelash curler of claim 1, wherein the flat support face of the clamping portion of the clamping member has a first side connecting the front arcuate guide face and a second side connecting the rear arcuate guide face.

* * * * *